US010315806B2

(12) United States Patent
Taratuta

(10) Patent No.: US 10,315,806 B2
(45) Date of Patent: Jun. 11, 2019

(54) COUPLING AND UNCOUPLING APPARATUS WITH LOCKABLE MECHANISM FOR BAGS AND PACKAGES

(71) Applicant: Leonid Taratuta, Staten Island, NY (US)

(72) Inventor: Leonid Taratuta, Staten Island, NY (US)

( * ) Notice: Subject to any disclaimer, the term of this patent is extended or adjusted under 35 U.S.C. 154(b) by 0 days.

(21) Appl. No.: 16/054,219

(22) Filed: Aug. 3, 2018

(65) Prior Publication Data

US 2019/0119005 A1 Apr. 25, 2019

Related U.S. Application Data

(60) Provisional application No. 62/576,053, filed on Oct. 23, 2017.

(51) Int. Cl.
*B65D 33/16* (2006.01)

(52) U.S. Cl.
CPC ..... *B65D 33/1675* (2013.01); *Y10T 24/15* (2015.01); *Y10T 24/44538* (2015.01)

(58) Field of Classification Search
CPC ..... Y10T 24/15; Y10T 24/3956; Y10T 24/44427; Y10T 24/4453; Y10T 24/44538; Y10T 24/44615; Y10T 24/44624; Y10T 24/44274; B65D 33/1675
USPC ..... 24/517, 487
See application file for complete search history.

(56) References Cited

U.S. PATENT DOCUMENTS

| | | | | |
|---|---|---|---|---|
| 3,604,071 | A | 9/1971 | Reimels | |
| 3,621,539 | A | 11/1971 | Ayers | |
| 3,713,622 | A * | 1/1973 | Dinger | A61M 39/28 251/10 |
| 3,982,307 | A | 9/1976 | Smith et al. | |
| 4,380,103 | A | 4/1983 | McGrath et al. | |
| 4,416,038 | A * | 11/1983 | Morrone, III | A44B 99/00 24/487 |
| 4,589,626 | A | 5/1986 | Kurtz et al. | |
| 4,807,622 | A | 2/1989 | Ohkaka et al. | |
| 4,926,526 | A | 5/1990 | Brown et al. | |
| 5,056,197 | A | 10/1991 | Cohen | |

(Continued)

FOREIGN PATENT DOCUMENTS

| | | | |
|---|---|---|---|
| DE | 4012848 | A1 | 4/1991 |
| GB | 2245639 | A | 1/1992 |

*Primary Examiner* — Abigail E Troy
(74) *Attorney, Agent, or Firm* — Werschulz Patent Law, LLC; Patricia P. Werschulz, Esq.

(57) ABSTRACT

A coupling and uncoupling apparatus for closing a bag or a package in the form of a clamp. The clamp has a latching assembly for closing the bag or package. The clamp can have at least one lock assembly. The at least one lock assembly is configured so that if breached or missing can be reasonably be expected to provide visible evidence that tampering has occurred. The clamp has a passage configured for a bag neck to pass through. The latching assembly may have two long complementary members, one on each arm that latch when closed or a plurality of short complementary latching members pairs disposed on each arm that latch when closed. this coupling and uncoupling apparatus is suitable not just for closing and sealing food bags and packages, but also for sealing tubing such as used in medical applications, as well as coupling and uncoupling wiring and cords.

4 Claims, 10 Drawing Sheets

(56) References Cited

U.S. PATENT DOCUMENTS

| | | | | | |
|---|---|---|---|---|---|
| 5,152,034 | A | * | 10/1992 | Konings ..... | B65D 33/1666<br>24/30.5 R |
| 5,682,649 | A | | 11/1997 | Lo | |
| 5,723,002 | A | | 3/1998 | Delk et al. | |

* cited by examiner

COUPLING AND UNCOUPLING APPARATUS WITH LOCKABLE MECHANISM FOR BAGS AND PACKAGES

CROSS-REFERENCE TO RELATED APPLICATIONS

This application is a nonprovisional utility application of the provisional patent application, Ser. No. 62/576,053, filed in the United States Patent Office on Oct. 31, 2017 and claims the priority thereof and is expressly incorporated herein by reference in its entirety.

TECHNICAL FIELD

The present disclosure relates generally to a closure. More particularly, the present disclosure relates to a coupling and uncoupling apparatus with lockable mechanism for bags and packages.

BACKGROUND

Proper food storage is important to maintain freshness. Perishables must be protected from moisture and oxygen, two things that promote spoilage. Bag closures and package clips that temporarily seal bags have been known for a long time.

Many clips are spring-loaded which often breaks with continual use. They are sometimes very heavy, unreliable, not easy to operate, have limited use and often very expensive. Simple closures are not air tight, allowing moisture and oxygen to enter.

Very few of the existing "chip" clips on the market are tamper evident. There is a need in the industry for a light, reliable, reusable, easy to operate and inexpensive solution.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a coupling and uncoupling apparatus for closing a bag or a package. Accordingly, an aspect of an example embodiment in the present disclosure provides a clamp with a latching assembly for closing a bag or a package.

A further aspect of an example embodiment in the present disclosure is to provide a coupling and uncoupling apparatus for securely closing a bag or a package. Accordingly, an aspect of an example embodiment in the present disclosure provides a clamp with a latching assembly and at least one lock assembly for securely closing a bag or a package.

Yet a further aspect of an example embodiment in the present disclosure is to provide a coupling and uncoupling apparatus for securely closing a bag or a package that is tamper-evident. Accordingly, yet a further aspect of an example embodiment in the present disclosure provides a clamp with a latching assembly for closing a bag or a package and at least one lock assembly that if breached or missing can be reasonably be expected to provide visible evidence that tampering has occurred.

Another aspect of an example embodiment in the present disclosure is to provide a coupling and uncoupling apparatus for securely closing a bag or a package around a bag neck. Accordingly, the present disclosure provides a clamp with a latching assembly, a passage configured for a bag neck to pass through and at least one lock assembly for securely closing a bag or a package.

Accordingly, the present disclosure describes a coupling and uncoupling apparatus for closing a bag or a package in the form of a clamp. The clamp has a latching assembly for closing the bag or package. The clamp can have at least one lock assembly. The at least one lock assembly is configured so that if breached or missing can be reasonably be expected to provide visible evidence that tampering has occurred. In one example embodiment, the clamp has a passage configured for a bag neck to pass through. The latching assembly may have two long complementary members, one on each arm that latch when closed or a plurality of short complementary latching member pairs disposed on each arm. This coupling and uncoupling apparatus is suitable not just for closing and sealing food bags and packages, but also for sealing tubing such as used in medical applications, as well as coupling and uncoupling wiring and cords.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

Figure 1A:
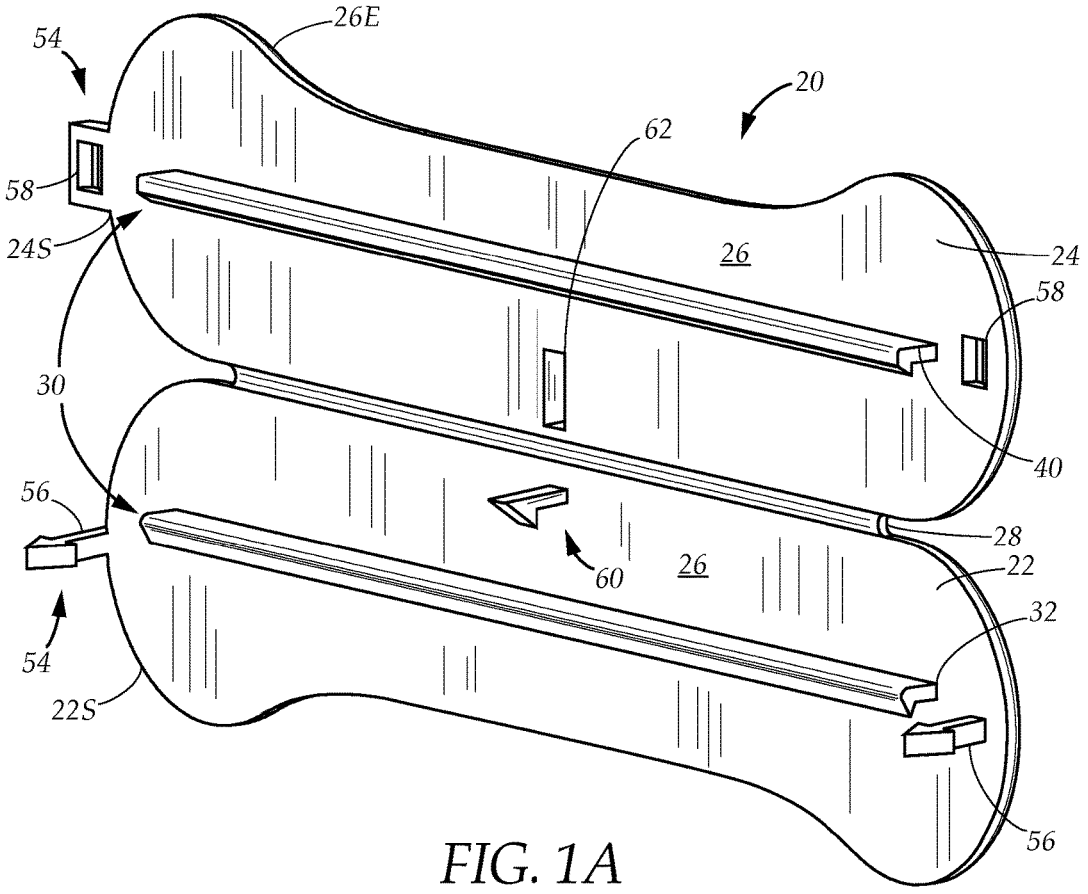
FIG. 1A is a perspective view of an example embodiment of a coupling and uncoupling apparatus in the form of a clamp.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

FIGS. 1A-3 illustrate an example embodiment of a coupling and uncoupling apparatus with a lockable mechanism for securely closing a bag or a package in the form of a clamp 20. In the present disclosure, the coupling and uncoupling apparatus is described in relationship to a bag, such as a food bag or package. However, it is understood that this coupling and uncoupling apparatus is suitable not just for closing and sealing food bags and packages, but also for sealing tubing such as used in medical applications, as well as coupling and uncoupling wiring and cords.

The clamp 20 has a pair of clamping arms 22, 24, each having an inner surface 26 and an outer surface, a first clamping arm 22 and a second clamping arm 24.

The clamp 20 has a hinge 28 connecting the pair of clamping arms 22, 24. The hinge 28 in the illustration is what is referred to as a living hinge. However, this is not a limitation and other types of hinges, such as, for example, but not limited to, a simple pin and knuckle, a ball and socket joint hinge, a snap on hinge or a piano hinge.

The clamp has a latching assembly on the inner surfaces 26 of the clamping arms 22, 24 having at least one pair of latching members, having a beak member 32 disposed on a first clamping arm 22 and a complementary hammer member 40 disposed on a second clamping arm 24 configured to slide over and engage the beak member. In one example embodiment, the latching members 32, 40 are linear, that is the latching members 32, 40 traverse the length of the clamping arms 22, 24.

Figure 3:
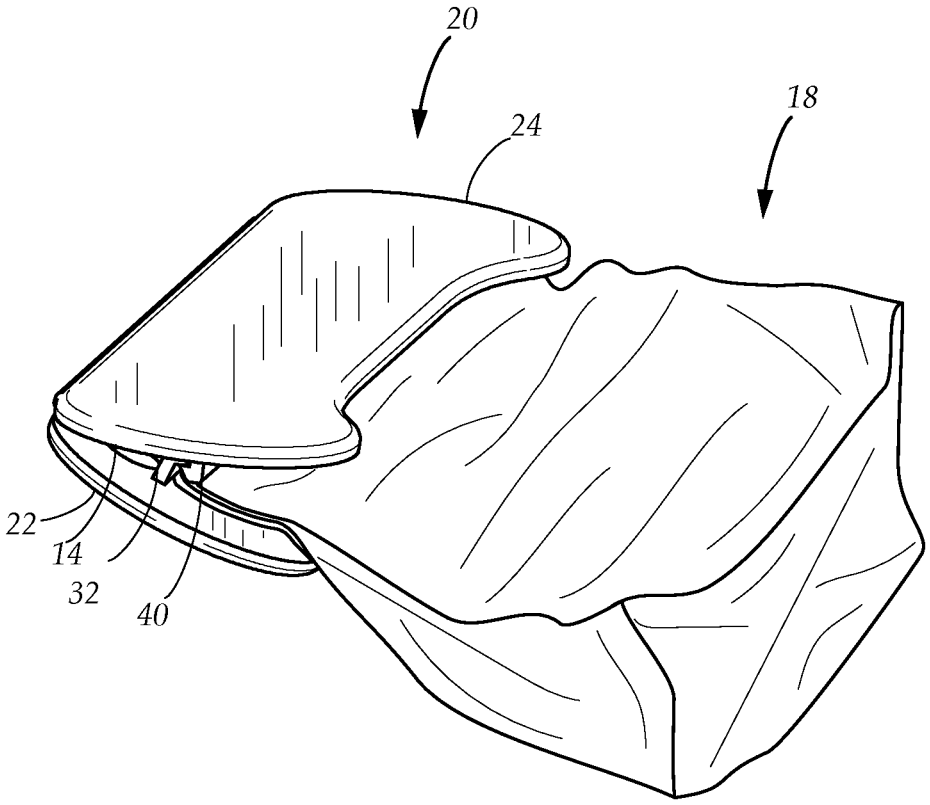
FIG. 3 is a perspective view of the camp closing a bag.

Referring to FIG. 3, the clamp 20 grasps a bag 18 between the first clamping arm 22 and the second clamping arm 24, the beak member 32 and hammer member 40 closing and sealing the bag 18.

Referring to FIGS. 1A-2D, the beak member 32 has a stem 36 extending upwardly from the inner surface 26 of the first clamping arm 22. The stem 36 has a rounded top head 34 and a triangular portion 38 extending outwardly from the rounded top head 34 away from the hinge 28.

The triangular portion 38 of the beak member 32 has an acute angle 48 extending outwardly from the round top head 34 away from the hinge.

The complementary hammer member 40 has a shaft 42 extending upwardly from the inner surface 26 of the second connected clamping arm 24. The shaft 42 has a right trapezoidal top portion 44 with an acute angle 46 extending toward the hinge 28.

The sum of degrees of the acute angle 48 of the beak member 32 and the acute angle 46 of the hammer member 40 is preferably equal to approximately ninety degrees.

The right trapezoidal top portion 44 of the complementary hammer member 40 has a long base 50 and the triangle portion 38 of the beak member 32 has a base 52 and the right trapezoidal top portion long base 50 of the complementary hammer member 40 engages the triangle base 52 of the beak member 32 when the clamp 20 is closed.

The clamp 20 as least one lock assembly configured to lock the clamp 20 in a closed position after the latching assembly 30 is engaged. There is a plurality of example embodiments of the at least one lock assembly illustrated in the drawings.

Figure 1B:
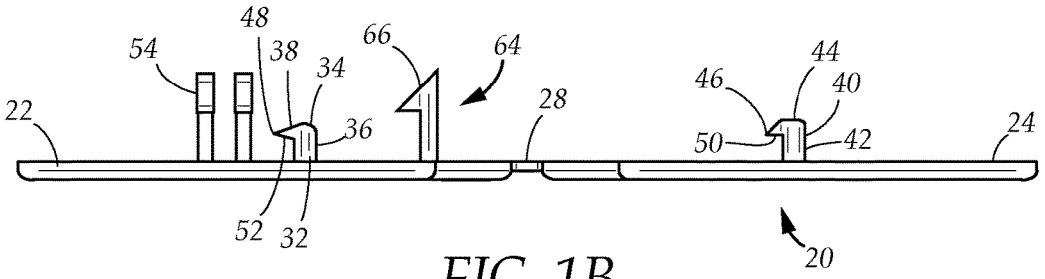
FIG. 1B is a side elevational view of the example embodiment of the clamp.

In FIGS. 1A and 1B, the at least one lock assembly is an arrow lock assembly 54. In one example embodiment, the arrow lock assembly 54 is on the surface 26 of the first clamping arm 22 and the second clamping arm 24. In another example embodiment, the arrow lock assembly 54 extends from a first clamping arm side 22S and a second clamping arm side 24S.

The arrow lock assembly 54 has an arrow head pin 56 and a triangular slit 58. The triangular slit 58 tapers from the opening such that when the arrow head pin 56 enters the triangular slit 58 and passes through to an outside surface 26E of the clamping arm 22, 24 the arrow lock assembly 54 irreversibly locks.

It is understood by those of ordinary skill in the art that while the drawings show the arrow head pin 56 is on first clamping arm 22 and the triangular slit 58 is on the second clamping arm 24, that this is not a limitation and that the arrow head pin 56 would function in the same manner on the second clamping arm 24 when the triangular slit 58 is on the first clamping arm 22.

In FIGS. 1A and 1B, the at least one lock assembly is a sliding pointer lock assembly 60. The sliding pointer lock assembly 60 has a sliding pointer head pin 64 and an elongated triangular slit 62 tapers from the opening such that when the pointer head pin 64 enters the elongated triangular slit 62 and passes through to an outside surface 26E of the clamping arm 22, 24 the sliding pointer lock assembly 60 locks. However, because the elongated triangular slit 62 is sufficiently elongated such that the entire pointer head 66 of the pointer head pin 64 can slide reversibly back and forth within the elongated triangular slit 62 reversibly locking and unlocking.

It is understood by those of ordinary skill in the art that while the drawings show the sliding pointer head pin 64 is on first clamping arm 22 and the elongated triangular slit 62 is on the second clamping arm 24, that this is not a limitation and that the arrow head pin 64 would function in the same manner on the second clamping arm 24 when the triangular slit 62 is on the first clamping arm 22. Further while the sliding pointer lock assembly 60 is shown attaching to the surface 26 of the clamping arms 22, 24, this is not a limitation and the sliding pointer lock assembly would function similarly if placed on the clamping arms sides 22S, 24S. It is also understood by those of ordinary skill in the art that the positions shown in the drawings of the sliding pointer head 64 and the elongated triangular slit 62 are not limitations and that these elements may be other positions within the inventive concept.

In FIGS. 2A-2D, the at least one lock assembly is an arcuate lock assembly 70 having an arcuate head pin 72 and a T-shape slit 78. The arcuate head pin 72 has a semicircular head 76 on a shaft 74. The semicircular head 76 fits through the T-shape slit bottom 78B and the shaft 74 slide upwardly through the T-shape slit stem 79, reversibly locking. To unlock, the shaft 74 slides downwardly through the T-shape slit stem 79 until the semicircular head 76 pops out of the T-shape slit bottom 78B.

Figure 2A:
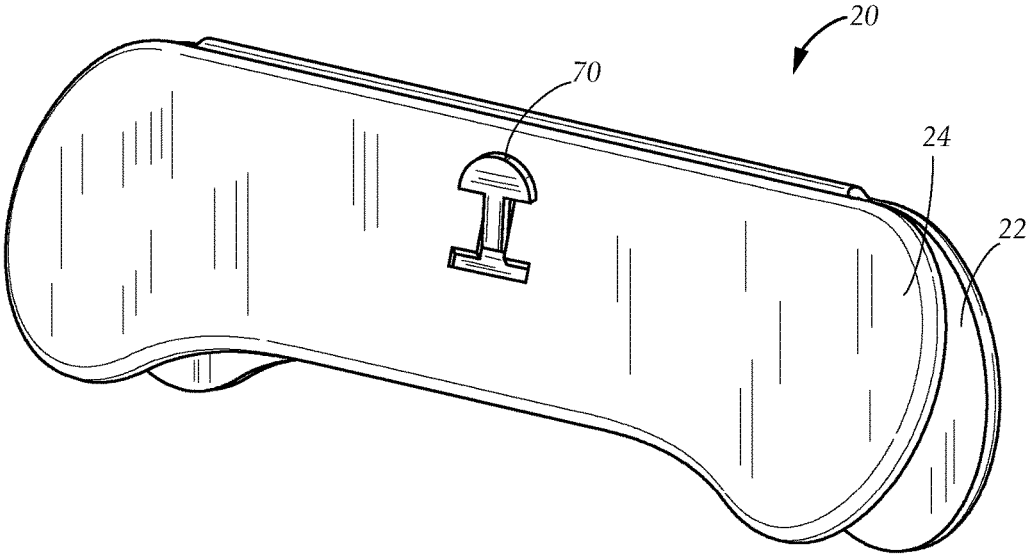
FIG. 2A is a perspective view of another example embodiment of a coupling and uncoupling apparatus in the form of a clamp.
Figure 2B:
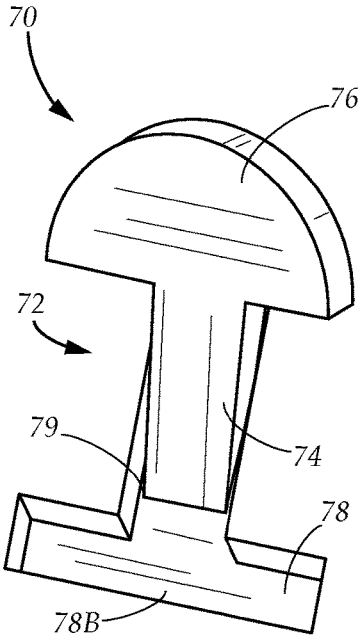
FIG. 2B is a perspective view of an example embodiment of a lock assembly for the clamp.
Figure 2C:
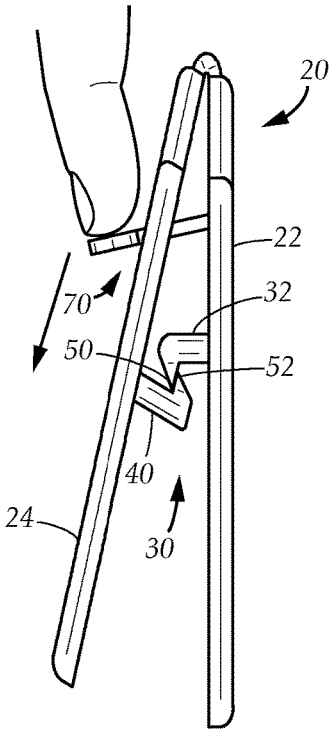
FIG. 2C is a side elevational view of the clamp with the lock assembly prior to engagement.
Figure 2D:
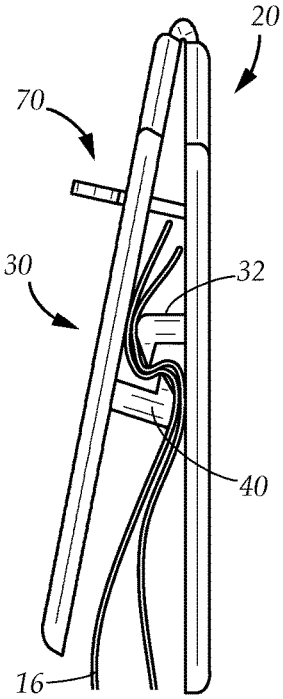
FIG. 2D is a side elevational view of the clamp with the lock assembly closing a bag with a lock fully engaged.

As shown in FIG. 2D, the clamp 20 has a pair of cords 16 clamped together between the beak member 32 and the hammer member 40. In one example embodiment, the latching assembly 30 is an electric conductor while the clamping arms 22, 24 are electrical insulators, thereby allowing an electrical connection to be made between the pair of cords 16.

It is understood by those of ordinary skill in the art that while the drawings show the arcuate head pin 72 is on first clamping arm 22 and the T-shaped slit 78 is on the second clamping arm 24, that this is not a limitation and that the arcuate head pin 72 would function in the same manner on the second clamping arm 24 when the T-shaped slit 78 is on the first clamping arm 22.

Figure 4A:
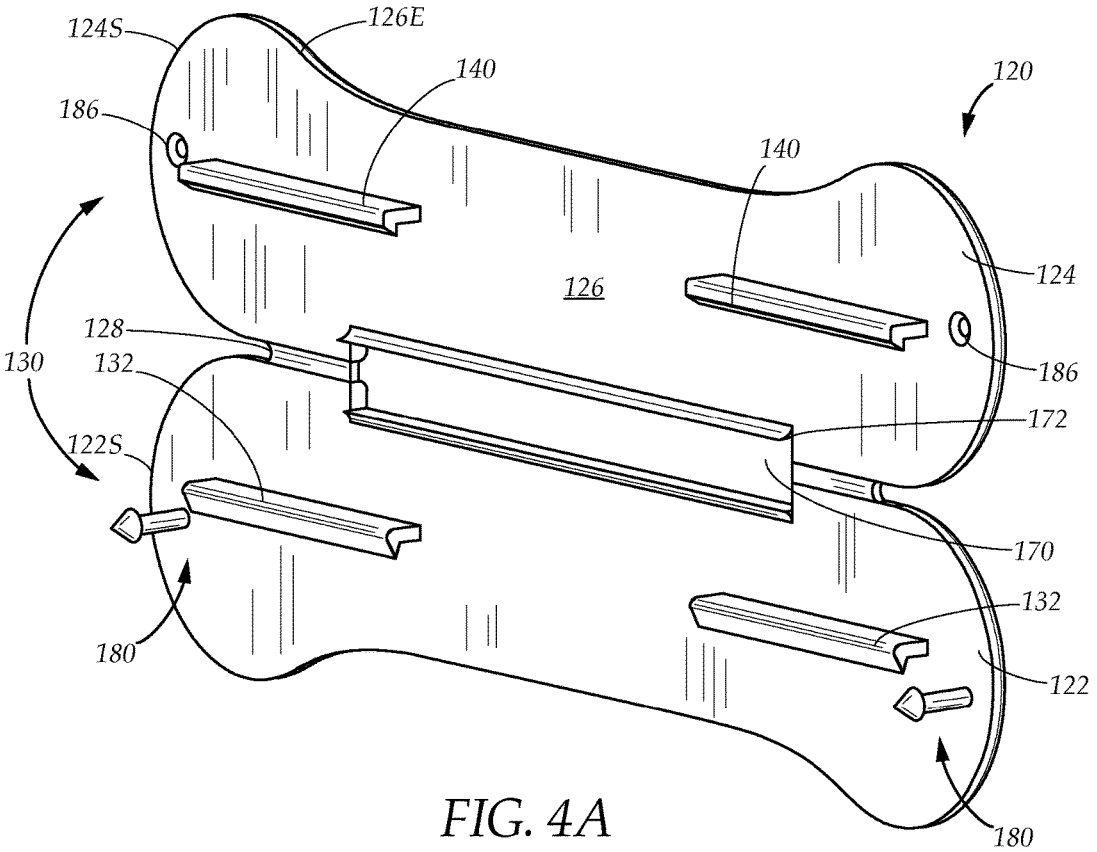
FIG. 4A is a perspective view of a further example embodiment of a coupling and uncoupling apparatus in the form of a clamp.
Figure 4B:
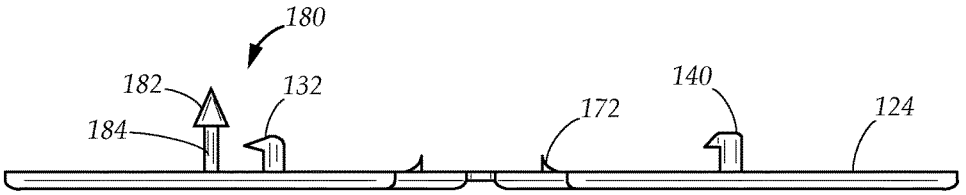
FIG. 4B is a side elevational view of the further example embodiment of the clamp.

FIGS. 4A-4B illustrate another example embodiment of a coupling and uncoupling apparatus with a lockable mechanism for securely closing a bag or a package in the form of a clamp 120.

The clamp 120 has a pair of clamping arms 122, 124, each having an inner surface 126 and an outer surface 126E, a first clamping arm 122 and a second clamping arm 124.

The clamp 120 has a hinge 128 connecting the pair of clamping arms 122, 124. The hinge 128 is discontinuous and bipartite, creating a passage 170 in the clamp 120 for the bag to pass through. The passage 170 has a raised rim 172.

The clamp 120 has a latching assembly 130 on the inner surfaces 126 of the clamping arms 122, 124, having two pairs of latching members 130, having a pair of beak members 132 disposed on a first clamping arm 122 and a complementary pair of hammer members 140 disposed on the second clamping arm 124 configured to slide over and engage the beak member 132 as described hereinabove with respect to the first example embodiment of the clamp.

In FIGS. 4A and 4B, the clamp 120 has at least one lock assembly. In this example embodiment, the at least lock assembly is a pair of frustoconical lock assemblies 180. In one example embodiment as illustrated, the frustoconical lock assemblies 180 are on the surface 126 of the first clamping arm 122 and the second clamping arm 124. In another example embodiment, it is understood that at least one of the frustoconical lock assemblies 180 can extend from a first clamping arm side 122S and a second clamping arm side 124S.

The frustoconical lock assemblies 180 each have a frustoconical head pin 182 on a stem 184 and a round slit 186. The round slit 186 tapers from the opening such that when the frustoconical head pin 182 enters the round slit 186 and passes through to an outside surface 126E of the clamping arm 124 the frustoconical lock assembly 180 irreversibly locks.

It is understood that the frustoconical lock assemblies 180 would function in the same manner on the second clamping arm 124, when the round slits are on the first clamping arm 122. It is also understood by those of ordinary skill in the art that the positions relative to the hinge and the latching assembly as shown in the drawings of the frustoconical lock assemblies 180 are not limitations and that these elements may be other positions within the inventive concept.

Figure 5:
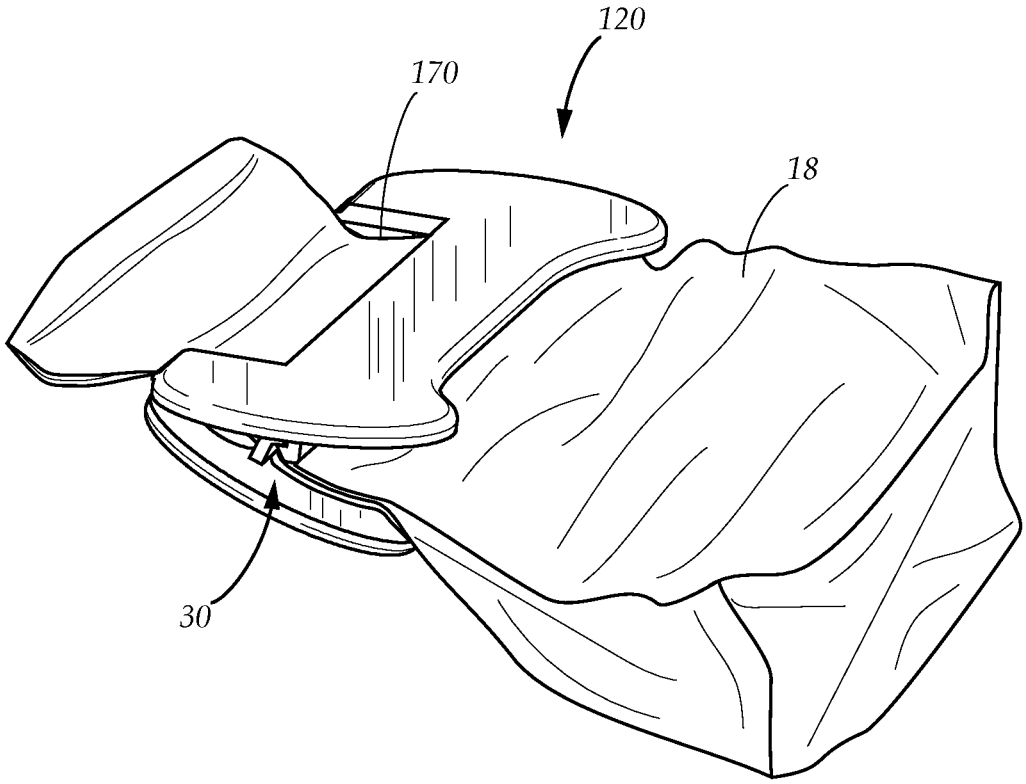
FIG. 5 is a perspective view of the further example embodiment of the clamp closing the bag.

FIG. 5 shows the bag 18 closed by the clamp 120 with the bag passing through the passage 170 and closed by the latching assembly 30.

Figure 6A:
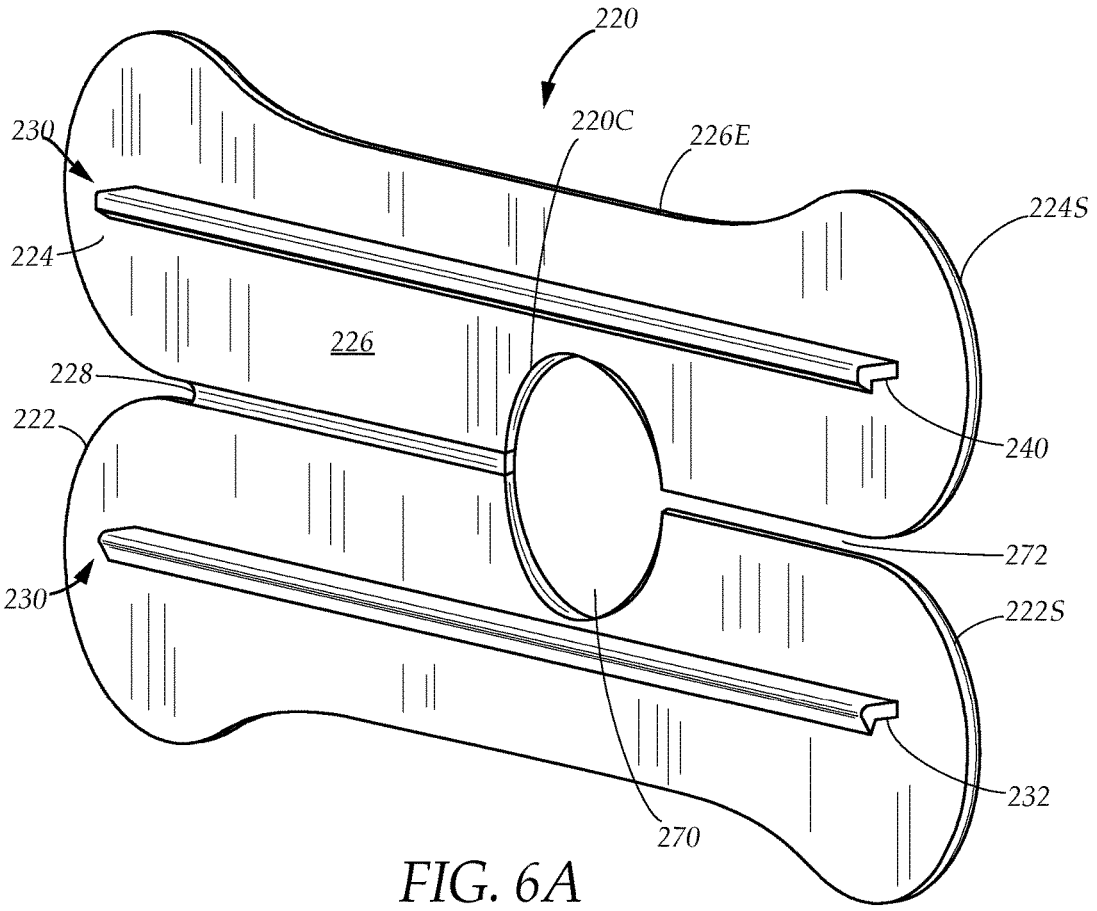
FIG. 6A is a perspective view of yet another example embodiment of a coupling and uncoupling apparatus in the form of a clamp.
Figure 6B:
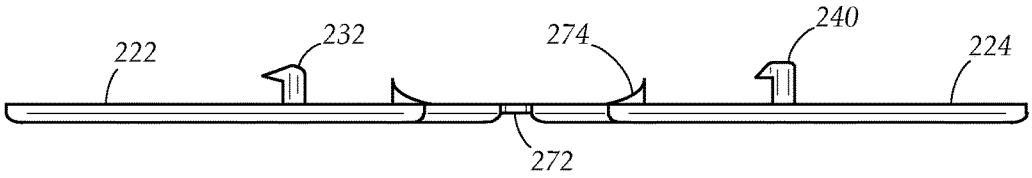
FIG. 6B is a side elevational view of the yet another example embodiment of the clamp.

FIGS. 6A-6B shows a further example embodiment of a coupling and uncoupling apparatus with a lockable mechanism for securely closing a bag or a package in the form of a clamp 220.

The clamp 220 has a pair of clamping arms 222, 224, each having an inner surface 226 and an outer surface 226E, a first clamping arm 222 and a second clamping arm 224.

The clamp 220 has a hinge 228 connecting the pair of clamping arms 222, 224. The hinge 228 is partial, extending from one end where the pair of clamping arms join towards the center, creating a key head passage 270 in the clamp center 220C for the bag to pass through and a slot 272 to pass the bag through to the key head passage 270. The slot 272 extends to a pair of the clamping arm sides 222S, 224S. The key head passage 270 has a raised rim 274.

The clamp 220 has a latching assembly 230 on the inner surfaces 226 of the clamping arms 222, 224 having a pair of latching members 230, having a beak member 232 disposed on a first clamping arm 222 extending the length of the first clamping and a complementary hammer member 240 disposed on the second clamping arm 224 extending the length of the second clamping arm configured to slide over and engage the beak member 232 as described hereinabove with respect to the first example embodiment of the clamp.

Figure 7:
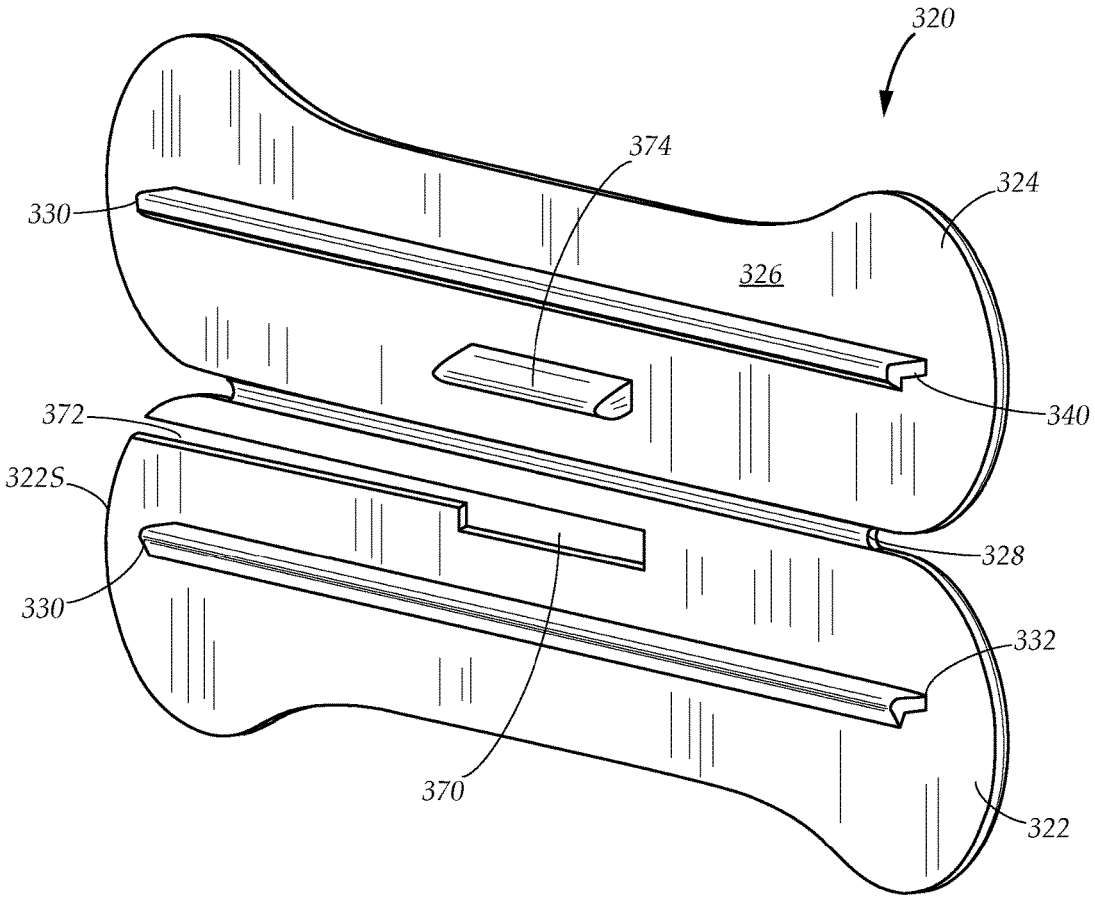
FIG. 7 is a perspective view of yet a further example embodiment of a coupling and uncoupling apparatus in the form of a clamp.

FIG. 7 shows yet another example embodiment of a coupling and uncoupling apparatus with a lockable mechanism for securely closing a bag or a package in the form of a clamp 320.

The clamp 320 has a pair of clamping arms 322, 324, each having an inner surface 326, a first clamping arm 322 and a second clamping arm 324.

The clamp 320 has a hinge 328 connecting the pair of clamping arms 322, 324.

The clamp 320 has a latching assembly 330 on the inner surfaces 326 of the clamping arms 322, 324 having a latching members 330, having a beak member 332 disposed on a first clamping arm 322 and a complementary hammer member 340 disposed on the second clamping arm 324 configured to slide over and engage the beak member 332 as described hereinabove with respect to the first example embodiment of the clamp.

A toothbrush passage 370 is in the first clamping arm 322 for the bag to pass through. The bag enters the toothbrush passage 370 through a passage slot 372 that extends to the first clamping arm side 322S. There is a chock 374 on the second clamping arm 324 that securely and snuggling fits into the toothbrush passage 370 when the clamp is closed with the latching assembly 330 engaged.

Figure 8:
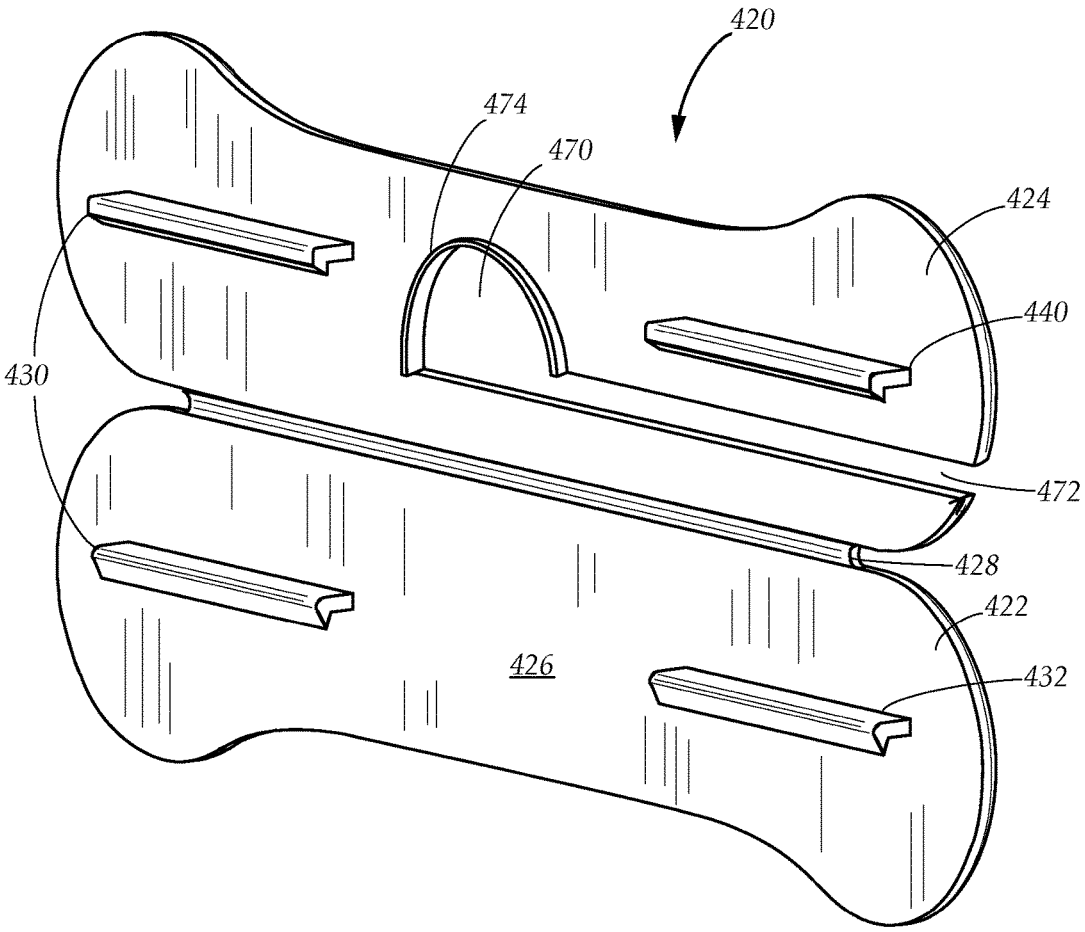
FIG. 8 is a perspective view of still a further example embodiment of a coupling and uncoupling apparatus in the form of a clamp.

FIG. 8 shows yet another example embodiment of a coupling and uncoupling apparatus with a lockable mechanism for securely closing a bag or a package in the form of a clamp 420.

The clamp 420 has a pair of clamping arms 422, 424, each having an inner surface 426, a first clamping arm 422 and a second clamping arm 424.

The clamp 420 has a hinge 428 connecting the pair of clamping arms 422, 424.

The clamp 420 has a latching assembly 430 on the inner surfaces 426 of the clamping arms 422, 424 having two pairs of latching members 430, having a pair of beak members 432 disposed on a first clamping arm 422 and a complementary pair of hammer members 440 disposed on the second clamping arm 424 configured to slide over and engage the beak member 432 as described hereinabove with respect to the first example embodiment of the clamp.

A half-note passage 470 is on the second clamping arm 424 for the bag to pass through. The bag enters the half-note passage 470 through a passage slot 472 and held in place by a rim 474. It is understood that the half-note passage 470 would function in the same manner on the first clamping arm 422 and that this is not a limitation to which clamping arm the toothbrush passage 470 is disposed.

Figure 9A:
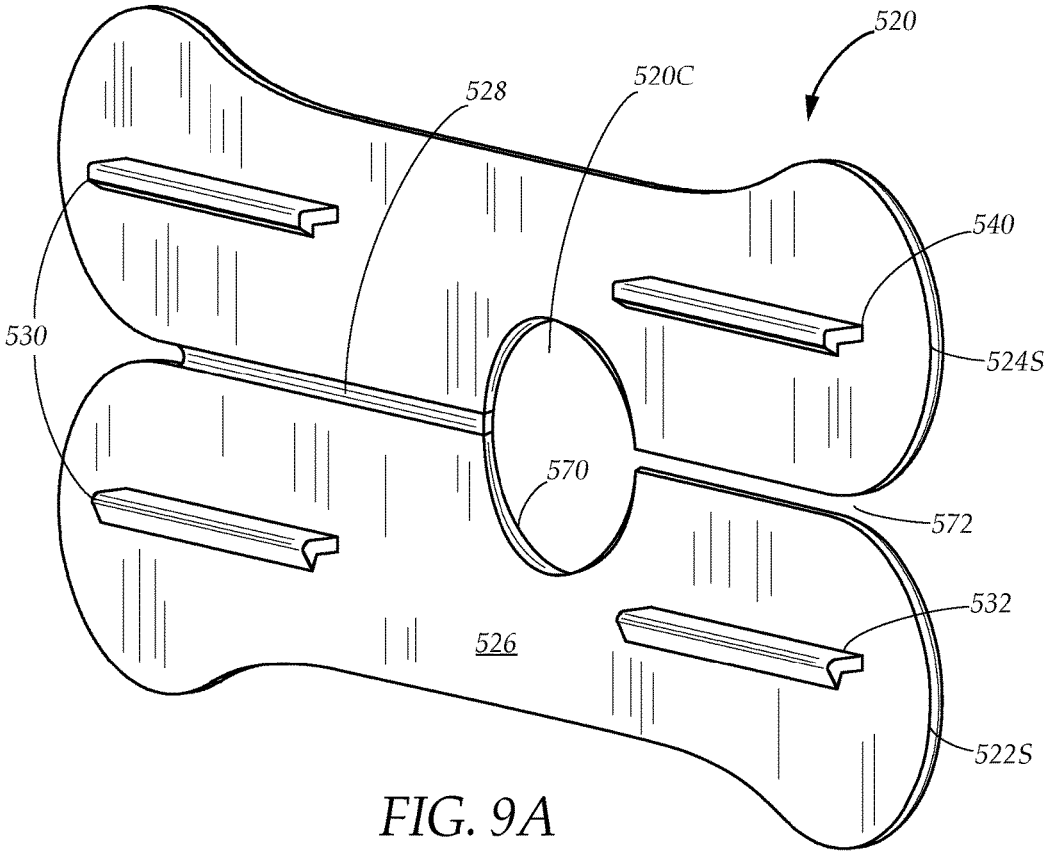
FIG. 9A is a perspective view of still another example embodiment of a coupling and uncoupling apparatus in the form of a clamp.
Figure 9B:
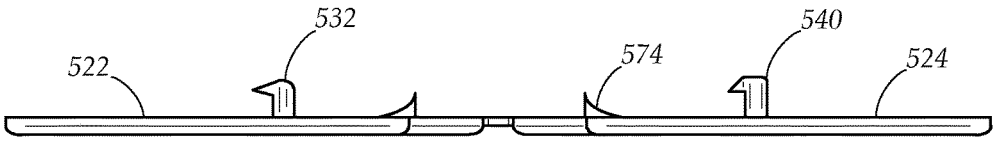
FIG. 9B is a side elevational view of the still another example embodiment of the clamp.

FIG. 9 shows yet another example embodiment of a coupling and uncoupling apparatus with a lockable mechanism for securely closing a bag or a package in the form of a clamp 520.

The clamp 520 has a pair of clamping arms 522, 524, each having an inner surface 526, a first clamping arm 522 and a second clamping arm 524.

The clamp 520 has a latching assembly 530 on the inner surfaces 526 of the clamping arms 522, 524 having two pairs of latching members 530, having a pair of beak members 532 disposed on a first clamping arm 522 and a complementary pair of hammer members 540 disposed on the second clamping arm 524 configured to slide over and engage the beak member 532 as described hereinabove with respect to the first example embodiment of the clamp.

The clamp 520 has a hinge 528 connecting the pair of clamping arms 522, 524. The hinge 528 is partial, extending from one end where the pair of clamping arms join towards the center, creating a key head passage 570 in the clamp center 520C for the bag to pass through and a slot 572 to pass the bag through to the key head passage 570. The slot 572 extends to a pair of the clamping arm sides 522S, 524S. The key head passage 570 has a raised rim 574.

It is understood by those of ordinary skill that the various lock assemblies disclosed hereinabove can be combined or substituted with the latching assembly in the various configurations of the clamping arms without and without slots and the various hinges as illustrated.

Figure 10:
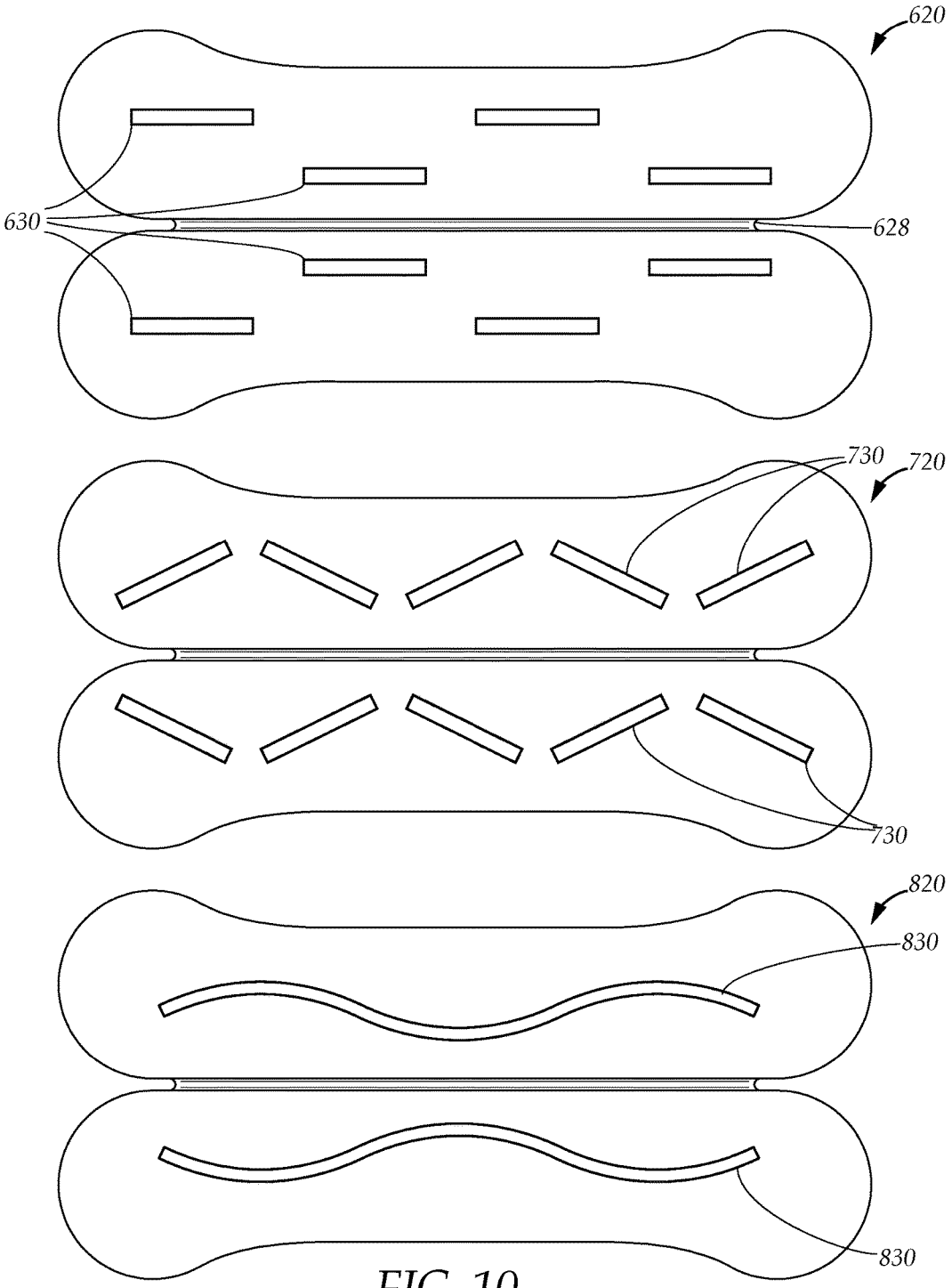
FIG. 10 is a top plan view of a plurality of latching members configurations.

FIG. 10 shows a plurality of positions that the latching assembly can be deployed within the inventive concept. The clamp 620 has a plurality of latching assemblies 630 deposed in a staggered manner, parallel to a hinge 628. The clamp 720 has a plurality of latching assemblies 730 deposed in a staggered manner, at an angle to a hinge 728. The clamp 820 has a latching assembly 830 deposed in a sinusoidal wave. These are non-limiting examples of latching assemblies and other possible configurations are contemplated within the inventive concept.

All the example embodiments of the clamp disclosed hereinabove are preferably formed from plastic materials that are resilient, that is, the clamp is able to recoil or spring back into shape after bending, stretching, or being compressed. The resilient plastic facilitates the hammer member and the beak member as well as the various locks engaging by snapping and clicking into place. The clamp may also be formed from other resilient materials, such as metal glasses, amorphous metals and alloys and steel. Material of composition is not a limitation.

The clamp is formed by extrusion molding, injection molding, thermoforming, blow molding, compression molding, laminating or spin casting. The method of forming the clamp is not a limitation.

A method for closing the bag with the clamp is illustrated in FIG. 3 and FIG. 1B. An open top 14 of the bag 18 is placed between the pair of hingedly connected clamping arms 22, 24 of the clamp 20 with the latching assembly 30 in a first step. Each of the clamping arms 22, 24 has one of the latching members of the latching assembly 30 disposed thereon. The beak member 32 is disposed on the first clamping arm 22 and the complementary hammer member 40 is disposed on the second clamping arm 24.

The complementary hammer member 40 disposed on the second clamping arm 24 is slid over the beak member 32 on the first clamping arm 22, the right trapezoidal top base 50 of the complementary hammer member 40 engaging the triangle base 52 of the beak member 32, thereby engaging the latching assembly 30 and closing the clamp 20 in a second step.

Referring to FIG. 1B, the method is reversed for opening the bag by the step of disengaging the right trapezoidal top base 50 of the hammer member 40 from the triangle base 52 of beak member 32, and removing the bag from between the clamping arms 22, 24 reversing the closing of the bag and thereby opening the bag.

The method can include the step of locking the clamp 20 after engaging the latching assembly 30 by engaging the lock assembly 54 having the pin 56 engage the triangular slit 58.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, members, components, regions, layers and/or sections, these elements, members, components, regions, layers and/or sections should not be limited by these terms. These terms are only used to distinguish one element, member, component, region, layer or section from another element, member component, region, layer or section. Thus, "a first element," "member," "component," "region," "layer" or "section" discussed herein could be termed a second element, member, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims. In conclusion, herein is presented a coupling and uncoupling apparatus with lockable mechanism for bags and packages The disclosure is illustrated by example in the drawing figures, and throughout the written description. It should be understood that numerous variations are possible, while adhering to the inventive concept. Such variations are contemplated as being a part of the present disclosure.

What is claimed is:

1. A clamp for closing a bag, comprising:

a first clamping arm and a second clamping arm, each clamping arm having an inner surface and an outer surface and a side;

a hinge connecting the first clamping arm and the second clamping arm;

a latching assembly having at least one pair of latching members, the at least one pair of latching members having a beak member disposed on the first clamping arm, the beak member of the latching assembly having a stem extending upwardly from the inner surface of the first clamping arm, the stem having a rounded top head and a triangular portion extending outwardly from the rounded top head away from the hinge, the triangular portion of the beak member having an acute angle extending outwardly from the rounded top head away from the hinge, the at least one pair of latching member further having a complementary hammer member disposed on the second clamping arm configured to slide over and engage the beak member, the complementary hammer member of the latching assembly having a shaft extending upwardly from the inner surface of the second clamping arm, the shaft having a right trapezoidal top portion with an acute angle extending toward the hinge, a sum of degrees of the acute angle of the beak member and the acute angle of the hammer member equaling approximately ninety degrees, the right trapezoidal top portion of the complementary hammer member having a right trapezoidal top base and the triangular portion of the beak member having a triangle base and the right trapezoidal top base of the complementary hammer member engages the triangle base of the beak member when the clamp is closed; and at least one lock assembly configured to lock the clamp in a closed position after the latching assembly is engaged, the at least one lock assembly locking irreversibly.

2. The clamp as described in claim 1, wherein the at least one pair of latching members is linear.

3. The clamp as described in claim 1, wherein the at least one pair of latching members is parallel to the hinge.

4. A clamp for closing a bag, comprising:

a first clamping arm and a second clamping arm, each having an inner surface and an outer surface and at least one side;

a hinge connecting the first clamping arm and the second clamping arm;

a latching assembly on the inner surfaces of the clamping arms having at least one pair of latching members, the at least one pair of latching members having a beak member disposed on the first clamping arm and a complementary hammer member disposed on the second clamping arm configured to slide over and engage the beak member; and a locking assembly having at least one pair of locking members, the at least one pair of locking members having a first locking member and a second locking member, the first locking member disposed on the at least one side of the first clamping arm and the second locking member disposed on the at least one side of the second clamping arm in a cooperating position with the first locking member.

* * * * *